United States Patent [19]

Nagel et al.

[11] 4,291,878

[45] Sep. 29, 1981

[54] STARTING GATE FOR A MULTIPLE-TRACK TOY VEHICLE RACING SET

[76] Inventors: Dietmar Nagel, 147 South Rd., Chester, N.J. 07930; Melvin Kennedy, 2 Fifth Ave., New York, N.Y. 10011

[21] Appl. No.: 67,229

[22] Filed: Aug. 17, 1979

[51] Int. Cl.[3] ..... A63F 9/14

[52] U.S. Cl. ..... 273/86 R; 46/1K

[58] Field of Search ..... 273/86 R, 86 B, 86 D; 46/1 K

[56] References Cited

U.S. PATENT DOCUMENTS

| | | | |
|---|---|---|---|
| 3,463,493 | 8/1969 | Guild | 273/86 B |
| 3,707,802 | 1/1973 | Tucker et al. | 273/86 R X |
| 4,108,437 | 8/1978 | DeAnda et al. | 46/1 K X |

*Primary Examiner*—Anton O. Oechsle
*Attorney, Agent, or Firm*—Bertram Frank

[57] ABSTRACT

A starting gate for use in connection with a multiple-track toy vehicle racing arrangement for releasing self-propelled toy vehicles onto the tracks includes a base having a plurality of bays each of which accommodates one toy vehicle prior to the start of the race. A blocking portion of a starting element retains the respective vehicle in the respective bay in an extended position of the starting element. A spring urges the starting element toward its extended position while the starting element can be displaced into its retracted position in which it releases the respective toy vehicle for travel on the respective track upon depression of an actuating portion of the starting element. The starting gate further includes a housing member accommodating an indicating member equipped with a cam follower received in a zig-zagging cam track of the housing member for retarding the gravity descent of the indicating member during a countdown sequence, and a plurality of indicating elements, one for each of the starting elements and pivotable by gravitational forces from a concealed to a revealed position thereof when the respective starting element is depressed during the countdown sequence.

15 Claims, 5 Drawing Figures

STARTING GATE FOR A MULTIPLE-TRACK TOY VEHICLE RACING SET

BACKGROUND OF THE INVENTION

The present invention relates to multiple-track toy vehicle racing arrangements in general, and more particularly to a starting gate for use in connection with such an arrangement for releasing self-propelled toy vehicles onto the tracks.

Multiple-track toy vehicle racing arrangements of various constructions are already known, as are various devices for starting the movement of the vehicles on the respective tracks. So, for instance, when the toy vehicles are propelled by an electric motor supplied with electric current from contact rails embedded in the respective tracks, a depression or flipping of a switch incorporated in the circuit between a source of electric energy and the respective contact rail will energize the motor of the respective vehicle and cause the vehicle to commence its travel on the respective track. On the other hand, when the toy vehicle is self-propelled, that is, when it carries its own energy source, such as a battery or a wind-up or inertial energy storing mechanism, it is customary to "charge" the vehicle and to place the same behind an obstruction which is removed at the beginning of the race. When referring to the charging of a self-propelled vehicle, it is to be understood that it encompasses, but is not limited to, the winding-up of the wind-up mechanism, storing energy in the inertial mechanism, closing the circuit between the battery and the driving motor, and the like. When the vehicle is charged within the definition explained above, it is ready to commence its movement onto and along the track immediately upon the removal of the obstruction.

When the racing arrangement is of the type using charged vehicles, it would be possible to use a single starting element for simultaneously removing the obstructions out of the way of all of the toy vehicles so that they start the race at exactly the same time. However, if this were done, both or all vehicles involved in the race would reach the finish line at exactly the same moment under ideal conditions, or one or some of the vehicle would always arrive at the finish later than the other or others if the quality of the tracks is not the same or the power of the vehicles is slightly different, or for any other reasons making the conditions less than ideal.

In addition thereto, the toy vehicle racing game or arrangement should simulate, to the extent feasible, the actual conditions existing in real road races. It will be appreciated that, in a real road race, a driver having the capability of quickly reacting to the sound of the starter's pistol, the appearance of a green light, or a similar audible or visual indication of the beginning of the race will obtain an advantage at the starting gate over those drivers whose capability to react is lower. Therefore, it is advantageous to so construct the starting gate that each of the participants of the toy vehicle race will actuate his or her own starting element to release the respective toy vehicle onto the track at the beginning of the race.

Where this expedient is resorted to, one of the participants could obtain an unfair advantage by actuating his or her starting element prematurely, that is, during the countdown sequence. This, of course, is undesirable.

SUMMARY OF THE INVENTION

Accordingly, it is a general object of the present invention to avoid the disadvantages of the prior art.

More particularly, it is an object of the present invention to develop a starting gate for use in connection with a multiple-track toy vehicle racing arrangement for releasing self-propelled toy vehicles onto the tracks which renders it possible to detect a premature release of the respective vehicle onto the associated track.

Yet another object of the invention is to so construct the starting gate of the type here under consideration as to be simple in construction, inexpensive to manufacture, and reliable nevertheless.

In pursuance of the above objects and others which will become apparent hereafter, one feature of the present invention resides, briefly stated, in a starting gate for use in connection with a multiple-track toy vehicle racing arrangement for releasing self-propelled toy vehicles onto the tracks, the starting gate including a base having a plurality of bays each for one of the vehicles and each aligned with one of the tracks; a plurality of starting elements each mounted on the base for independent displacement between an extended and a retracted position and each having a blocking portion retaining the respective vehicle in the respective bay in the extended position and releasing the respective vehicle for travel from the respective bay onto the respective track in the retracted position of the starting element, and an actuating portion displacing the starting element at least into the retracted position upon actuation. The starting gate further includes first indicating means for indicating a countdown sequence preceding the start, and second indicating means for indicating a premature displacement of a respective starting element into the retracted position prior to the termination of the countdown sequence.

When the starting gate is constructed in this manner, the displacement of any of the starting elements into its retracted position while the first indicating means still indicates a countdown sequence will be indicated by the second indicating means, thus rendering it possible either to disqualify the person who had prematurely actuated the starting element or to repeat the race.

A particularly advantageous embodiment of the present invention is obtained when the starting elements are mounted in a cavity provided in the base, and when the base includes at least two openings for each of the starting elements through which the blocking and actuating portions of the latter extend to the exterior of the base at least in the extended position. Advantageously, the starting elements are biased toward their extended positions by biasing means, such as a leaf spring which is mounted on the base within the above-mentioned cavity and which acts on the respective starting element, which is mounted on the base for individual pivoting between the aforementioned positions, to urge the same towards its extended position. This particular structure has the advantage of low manufacturing and assembling costs.

According to the further aspect of the present invention, the starting gate further includes a hollow housing member which supports the first and second indicating means, the housing member and the base having aligned apertures communicating the cavity with the interior of the housing member. Then, each of the starting elements further has a control portion extending through the apertures and controlling the operation of at least the second indicating means. Then, it is further advantageous when the second indicating means includes an indicating element for each of the starting elements, the indicating element being mounted in the housing member for movement between a concealed and a revealed position in which it is respectively invisible and visible externally of the housing member and which is urged toward the revealed position, and means for resetting the indicating elements into the concealed positions thereof. Under these circumstances, it is particularly advantageous for the control portion of the respective starting element to so engage the indicating element as to maintain the same in the concealed position as long as the respective starting element assumes the extended position thereof, while releasing the same for movement toward the revealed position upon displacement of the respective starting element toward its retracted position. A particularly simple and inexpensive construction is obtained when the indicating element is mounted in the housing member for pivoting about an axis and has a center of gravity sufficiently off-set from its pivoting axis for gravitational forces to pivot the indicating element toward its revealed position upon release by the control portion. A particular advantage of this last-mentioned expedient is that it is not necessary to employ any springs or similar biasing means which would make the construction more expensive.

In a very simple and otherwise advantageous embodiment of the present invention, the housing member has at least one zone for which light can pass into and out of the interior of the housing member, the indicating element being respectively in and out of registry with the zone in the revealed and concealed position thereof. In this manner, the indicating element is fully and inaccessibly accommodated in the interior of the housing member so that it cannot be tampered with.

The first indicating means of the present invention advantageously includes an indicating member which is supported by the housing member for displacement during the countdown sequence from a first to a second position and which has engaging portions each of which so engages one of the engaging elements at least when the latter is in the concealed position and only while the starting member is at the second position thereof as to keep the respective indicating element in the concealed position even upon release thereof by the respective control portion of the respective starting element. In other words, when the indicating member is in, or closely approaches, its second position at the end of the countdown sequence, the engaging portion will prevent the respective indicating element from being displaced into its revealed position and thus from mistakenly indicating the actuation of the respective starting element during the countdown sequence. On the other hand, should the actuation of the respective starting element take place during the countdown sequence, that is, before the arrival of the indicating member at its second position, the respective engaging portion of the indicating member will not engage the associated indicating element and the latter, which is no longer held by its associated control portion, will move into its revealed position in which it indicates the premature actuation of the respective starting element.

According to another facet of the present invention, the indicating member is at least partially accommodated in the housing member, and the housing member has at least one light-permeable portion through which the progress of the indicating member from the first to the second position during the countdown sequence can be observed. In this manner, each of the persons involved in the operation of the starting elements will be visually apprised of the degree and rate of displacement of the indicating member towards its second position.

Especially in the currently preferred construction of the starting gate of the present invention where the indicating member descends due to gravitational forces alone, but, generally speaking, in all constructions where the starting member is subjected to forces of such magnitude during the countdown sequence as to tend to proceed toward the second position at an undesirably high speed, it is further advantageous to provide means for retarding the progress of the indicating member at least toward the second position thereof. Advantageously, the retarding means includes a cam track on one of the above-mentioned members, and a cam follower on the other member, the cam follower contacting the cam track of the above-mentioned one member. It is further advantageous when the cam track includes at least one cam track surface which is contacted by the cam follower and which slopes downwardly over its entire course.

It is further advantageous when, in accordance with an additional feature of the present invention, the cam surface includes a plurality of separate first sections sloping in one direction, and the cam track further includes an additional cam surface including a plurality of separate second sections situated in alternating succession with the first sections and sloping in the opposite direction so that the first and second sections cause the cam follower to travel in a zig-zagging path during the countdown sequence. Under these circumstances, the cam follower alternatively contacts the first and second sections, slides downwardly thereon either in the one or in the opposite direction, and its movement, which is determinative of the descent of the indicating member, is retarded by the friction with the first and second sections and the confinement for movement in the zig-zagging path. To prevent the cam follower from leaving the cam track between the first and second sections, the cam track further includes first and second connecting zones which respectively interconnect the first and second sections with one another.

Accordingly, the invention consists in the features of construction, combination of elements, and arrangement of parts which will be exemplified in the article of manufacture herein described and of which the scope of application will be indicated in the dependent claims.

A BRIEF DESCRIPTION OF THE DRAWINGS

In the accompanying drawings, in which the currently preferred embodiment of the present invention is shown:

A DETAILED DISCUSSION OF THE PREFERRED EMBODIMENT

Figure 1:
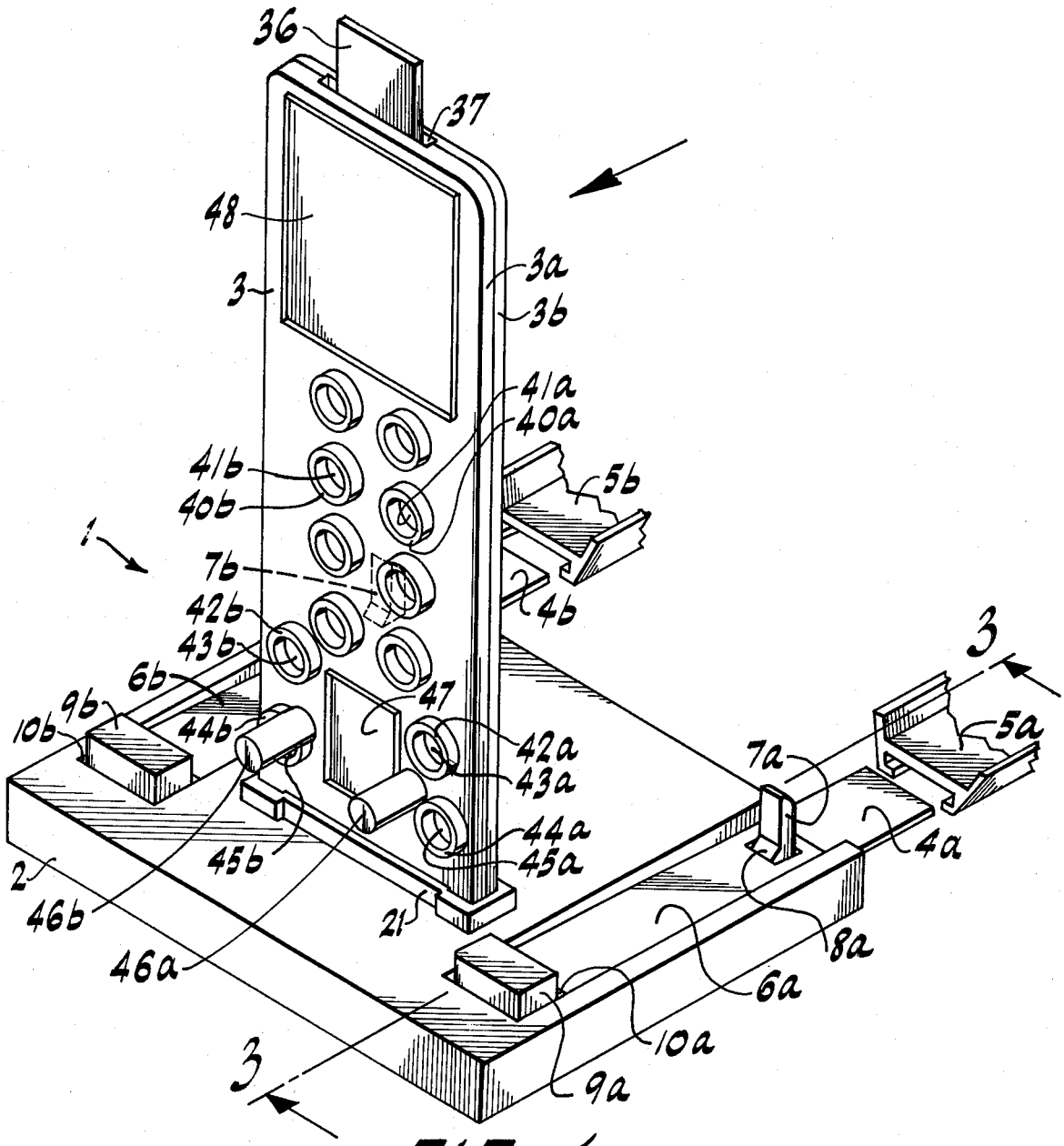
FIG. 1 is a perspective view of the starting gate according to the present invention, ready to be connected to respective ends of tracks of a racing arrangement.

Referring now to the drawings in detail and first to FIG. 1 thereof, it may be seen that reference numeral 1 designates the starting gate in toto. The starting gate 1 includes a base 2 and a housing member 3 mounted on and extending upwardly from the base 2. The housing member 3 includes two shell-shaped parts 3*a* and 3*b* which are connected to one another to constitute the housing member 3.

The base 2 of the starting gate 1 includes two plate-shaped projections 4*a* and 4*b* to which respective ends of tracks 5*a* and 5*b* can be connected. The base 2 also includes two depressions 6*a* and 6*b*, each of which constitutes a bay in which a respective charged toy vehicle can be accommodated prior to the beginning of the race. Blocking portions 7*a* and 7*b*, and actuating portions 9*a* and 9*b* of respective starting elements 11*a* (see FIG. 3) and 11*b* extend through respective openings 8*a*, 8*b*, 10*a* and 10*b* from the interior of the base 2 to the exterior thereof, and, as illustrated, into the respective depressions 6*a* and 6*b*. The respective blocking portion 7*a* blocks the respective charged vehicle in the respective depression 6*a* or 6*b* until the depression of the respective actuating portion 9*a* or 9*b* causes the respective blocking portion 7*a* or 7*b* to be withdrawn into the interior of the base 2, thus removing the only obstruction which maintains the charged vehicle in the respective depression 6*a* or 6*b*. Evidently, the respective blocking portion 7*a* has to extend into the respective depression 6*a* or 6*b*; on the other hand, the actuating portion 9*a* or 9*b* can be situated at any convenient location, not necessarily in or at the respective depression 6*a* or 6*b*.

Figure 3:
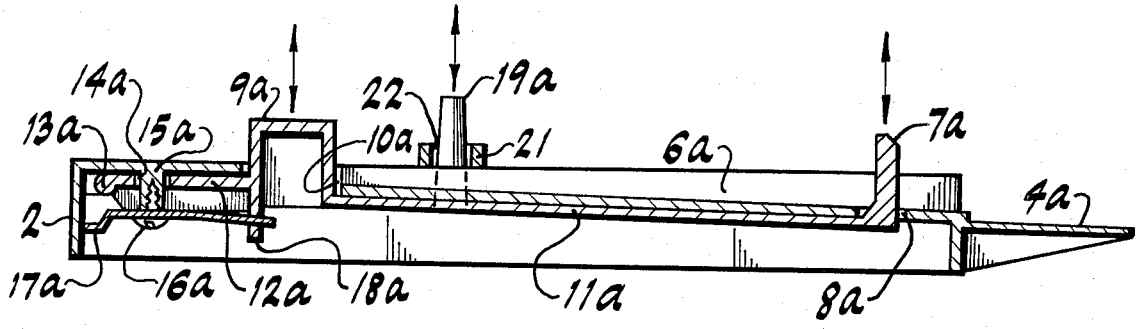
FIG. 3 is a cross-sectional view taken on line 3—3 of FIG. 1.

Referring now to FIG. 3, it may be seen that the starting element 11*a* shown in detail therein has, in addition to the above-mentioned blocking and actuating portions 7*a* and 9*a*, a mounting portion 12*a* which has a rounded end zone 13*a* on which the starting element 11*a* is supported in the interior of the base 2. The mounting portion 11*a* has a hole 14*a* therein, a projection 15*a* of the base 2 extends through this hole 14*a*. The projection 15*a* is internally threaded, and a screw 16*a* or similar connecting element is received therein. The screw 16*a* connects a leaf spring 17*a* to the projection 15*a* and thus to the base 2. A free end portion of the spring 17*a* is received in a recess 18*a* of the starting element 11*a* and urges the starting element 11*a* in the upward direction as considered in FIG. 3. Hence, the spring 17*a* urges the starting element 11*a* toward the extended position thereof illustrated in FIG. 3.

Figure 2:
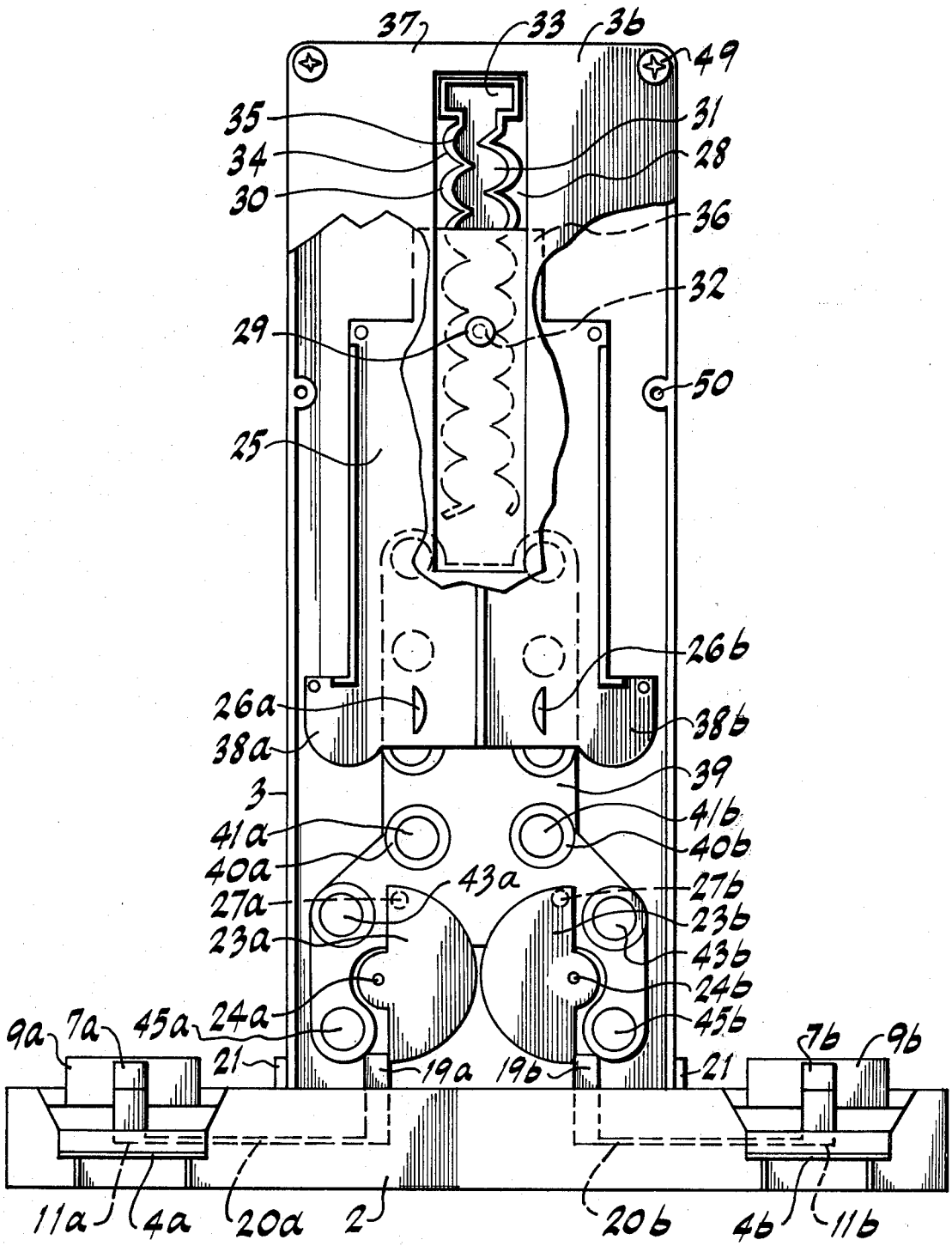
FIG. 2 is a partially sectioned rear elevation view of the starting gate, as seen in the direction of the Arrow of FIG. 1.

As a comparison of FIGS. 2 and 3 will reveal, the starting element 11*a* further includes a control portion 19*a* which is connected to the remainder of the starting element 11*a* by a connecting portion 20*a*. Consequently, the connecting portion 20*a* and, with it, also the control portion 19*a*, will pivot about the end portion 13*a* of the starting element 11*a*, together with the remainder of the starting element 11*a*. The control portion 19*a* extends to the exterior of the base 2 through a channel 22 which is bounded by a ridge 21. As best seen in FIG. 3, the channel 22 serves to receive the lower end of the housing member 3, and the presence of the ridge 21 serves to improve the holding of the housing member 3 in the illustrated upright position. Also, the friction between the surfaces bounding the channel 22 and the external surfaces of the housing member 3 prevents the accidental expulsion of the housing member 3 out of the channel 22 during the operation of the starting gate 1.

Figure 4:
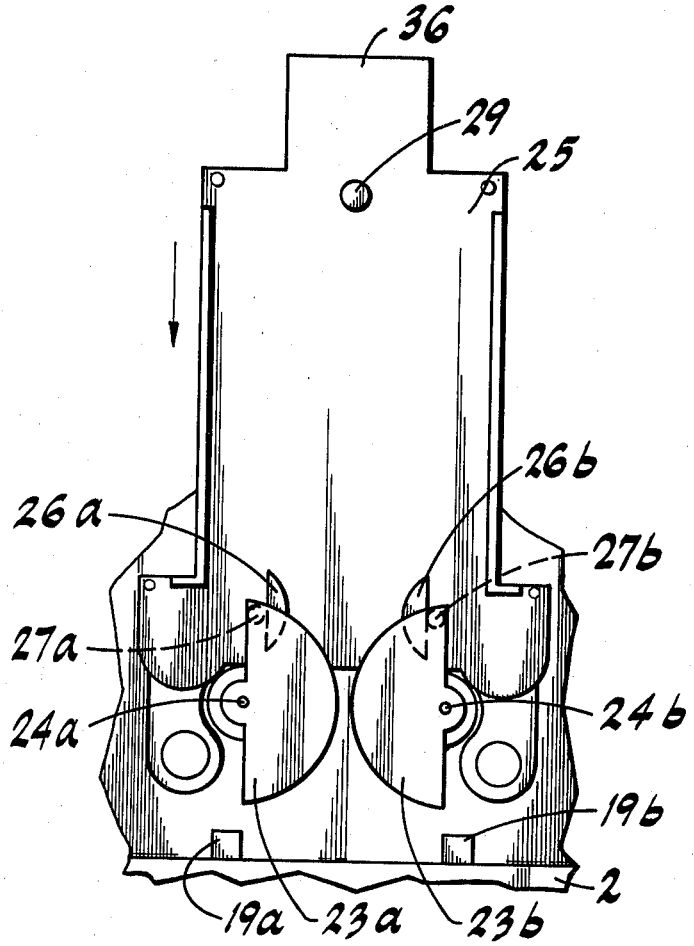
FIG. 4 is a fragmentary rear elevational view of certain components of the starting gate, taken in direction of the Arrow of FIG. 1.
Figure 5:
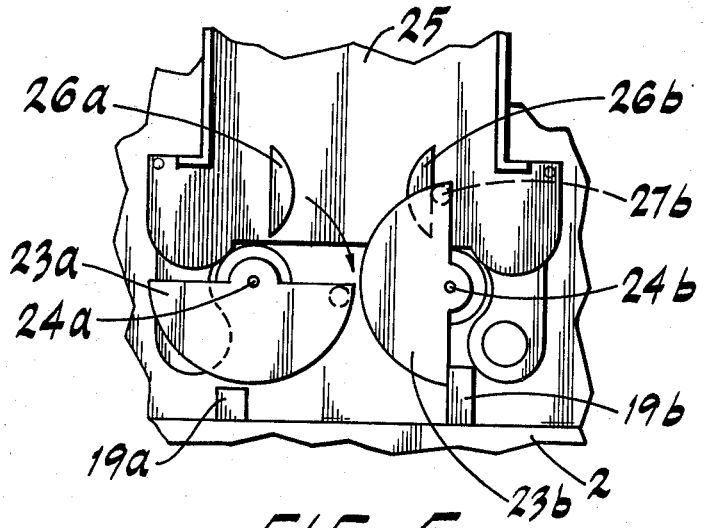
FIG. 5 is a view similar to FIG. 4, but illustrating the components in different positions.

As particularly well seen in FIG. 2, and also in FIGS. 4 and 5, the housing 3 is hollow and the control portion 19*a*, as well as the corresponding control portion 19*b* of the starting element 11*b*, extend into the interior of the housing member 3. The interior of the housing 3 further accommodates two indicating elements 23*a* and 23*b*, each associated with one of the starting elements 11*a* and 11*b*, and each mounted for pivoting about its mounting portion 24*a* or 24*b*. Each of the indicating elements 23*a* and 23*b* has a substantially semi-circular contour, so that its center of gravity is offset from the axis of the respective mounting portion 24*a* or 24*b*. Consequently, the indicating elements 23*a* and 23*b* must be held, in one way or the other, in their positions illustrated in FIG. 2; otherwise, the gravitational forces acting thereon would displace them into the equilibrium position corresponding to that shown in the left-hand part of FIG. 5.

In the situation illustrated in FIG. 2, which shows the position of the various components assumed during a countdown sequence which will be discussed later on, the indicating elements 23*a* and 23*b* are held in their unstable positions illustrated in FIG. 2 by the respective control portions 19*a* and 19*b* which extend into the path of the pivotal movement of the indicating elements 23*a* and 23*b* toward their equilibrium positions. It will be appreciated that, once the respective control portion 19*a* or 19*b* is retracted as a result of the depression of the respective actuating portion 9*a* or 9*b*, the respective indicating element 23*a* or 23*b* is released for pivoting about the mounting portion 24*a* or 24*b* into its equilibrium position. In the situation illustrated in FIG. 2, each of the indicating elements 23*a* and 23*b* would not only be released for pivoting towards its equilibrium position, but would actually pivot into such position.

FIGS. 2, 4 and 5 also illustrate an indicating member 25 which is equipped with protrusions 26*a* and 26*b*. Each of the indicating elements 23*a* and 23*b* is equipped with a respective pin or a similar abutment 27*a* or 27*b*. The pins 27*a* and 27*b* are located adjacent the path of downward movement of the protrusions 26*a* and 26*b* of the indicating member 25 in the positions of their indicating elements 23*a* and 23*b* illustrated in FIG. 2. When the indicating elements 23*a* and 23*b* are maintained by the control portions 19*a* and 19*b* of the starting elements 11*a* and 11*b* in these positions until the protrusion 26*a* and 26*b* of the indicating member 25 reach their positions illustrated in FIG. 4, then the protrusions 26*a* and 26*b* will be abutted by the pins 27*a* and 27*b* upon the displacement of the control portions 19*a* and 19*b* of the starting elements 11*a* and 11*b* into their retracted positions as illustrated in FIG. 4. The cooperation of the pins 27*a* and 27*b* with the protrusions 26*a* and 26*b* will thus prevent the indicating elements 23*a* and 23*b* from pivoting into their equilibrium positions.

The situation is otherwise should one or both of the starting elements 11*a* and 11*b* be actuated or pivoted prior to the termination of the countdown sequence, that is, prior to the reaching of the position illustrated in FIGS. 4 and 5 by the indicating member 25. Under these circumstances, the control portion 19*a* or 19*b* of the starting element 11*a* or 11*b* is retracted while the actuating member 25 is, for instance, in the position illustrated in FIG. 2. When this happens, the respective indicating element 23*a* and 23*b* will pivot into into its equilibrium position, inasmuch as there is nothing restraining its pivotal movement when the respective control portion 19*a* or 19*b* has been withdrawn prior to the introduction of the protrusion 26*a* or 26*b* of the indicating member 25 into the path of the pivotal movement of the respective pin 27*a* or 27*b*. The end result of this is that, when the indicating member 25 reaches its lowermost position, as shown in FIG. 5, the indicating element 23*a* whose control portion 19*a* has been withdrawn prematurely will have pivoted into its equilibrium position as indicated by the arrow in FIG. 5, and remains in this position. This is the result of the fact that the protrusion 26*a* had arrived into the path of the pivotal movement of the pin 27*a* too late for preventing the pin 27*a* from conducting its pivotal movement, together with the remainder of the indicating element 23*a*, about the axis of the axle 24*a*.

Of course, it is necessary to lift the indicating member 25 into its raised position before it can descend toward its lowered end position. Therefore, the part 3*b* of the housing 3 is provided with an opening 28, and the indicating member 25 is equipped with a gripping portion or pin 29 which passes through the opening 28 to the exterior of the housing member 3 so that it can be gripped thereat and lifted, together with the remainder of the indicating member 25, toward the raised position of the latter.

The indicating member 25 descends by gravity alone; in other words, no spring or other biasing element or mechanical device acts on the indicating member 25 during its descent. Given the gravity acceleration, the indicating member 25 would descend too fast for providing a countdown sequence of any meaningful duration. For this reason, the housing member 3 is provided with a cam track 30 which bounds a passage 31, and the indicating member 25 has a cam follower 32 which is received in the passage 31 and follows the cam track 30 during descent of the indicating member 25. The cam track 30 has an enlarged upper end portion, as indicated at 33 into which the cam follower 32 can be introduced and in which it is held prior to the commencement of the countdown sequence. The cam track 30 is constituted by downwardly sloping sections 34 with which the cam follower 32 comes in contact, and by connecting portions 35 which interconnect the individual sections 34 with one another and thus prevent the cam follower 32 from accidentally leaving the passage 31 through any of the spaces between the successive sections 34. It may be seen that the sections 34 which are arranged at opposite sides of the passage 31 slope in opposite directions so that the passage 31 obtains a zig-zagging configuration and the cam follower 32 is forced to travel in a zig-zagging path during descent of the indicating member 25. Of course, inasmuch as the cam follower 32 travels in a zig-zagging path during the descent of the indicating member 25, the entire indicating element will conduct a wobbling motion, and the opening 28 is made wide enough to permit such a wobbling motion of the gripping portion 29 therein without interference.

As also seen in FIG. 2, the indicating member 25 has a portion 36 which is of a smaller transverse dimension than the remainder of the indicating member 25 and which passes to the exterior of the housing member 3 in the uppermost position of the indicating member 25, through an opening 37 provided for this purpose. This situation is illustrated in FIG. 1. The purpose of this portion 36 is to displace the indicating member 25 from a position in which the cam follower 32 is received in the enlarged upper end portion 33 of the passage 31, into the entrance of the zig-zagging portion of the passage 31, or vice versa. It will be appreciated that, while the cam track 30 has been illustrated as being provided on the housing member 3, particularly on its part 3*a* and the cam follower has been described as being provided on the starting element 25, the situation could also be reversed, that is, the cam track 30 could be provided on the indicating member 25, and the cam follower 32 on the housing member 3. Under these circumstances, of course, the enlarged portion 33 would be located at the lower, rather than the upper, end of the passage 31.

The indicating member 25 has two outwardly extending portions 38*a* and 38*b*. The housing portion 3*a* has incorporated therein an integral member 39 which is preferably of a transparent material. The member 39 has respective annular portions 40*a* and 40*b* which bound respective openings 41*a* and 41*b*, annular portions 42*a* and 42*b* which bound respective openings 43*a* and 43*b*, and annular portions 44*a* and 44*b* which bound respective openings 45*a* and 45*b*. Portions of the interior of the housing member 3 and of the components accommodated therein can be observed through the respective openings 41*a*, 41*b*, 43*a* and 43*b*.

Advantageously, the front surface of the indicating member 25, that is, that surface which faces the housing part 3*a* and the openings 41*a*, 41*b*, 43*a* and 43*b* in the lowermost position of the indicating member 25, is colored yellow in the region which is visible in the openings 41*a* and 41*b* during and upon the descent of the indicating member 25, while those regions of the front surface which are provided on the extensions 38*a* and 38*b* are colored green. These regions are visible in the openings 43*a* and 43*b* in the lowermost position of the indicating member 25. Finally, the openings 45*a* and 45*b* are so situated that the front surface of the respective indicating elements 23*a* or 23*b* will be visible therein only when the respective indicating elements 23*a* or 23*b* assumes its equilibrium position.

FIG. 1 also illustrates that each of the indicating elements 23*a* and 23*b* is equipped with its respective substantially cylindrical resetting portion 46*a* or 46*b* which is located at the exterior of the housing member 3 and which can be turned for jointly pivoting the respective indicating element 23*a* or 23*b* into its concealed position which is shown in FIG. 4. In this position, the respective indicating element 23*a* or 23*b*, which is preferably colored red, is invisible or concealed from view through the respective opening 45*a* or 45*b*.

FIG. 1 also illustrates the front face of the housing part 3*a* may be provided with two depressions or similar display areas 47, 48 on which details identifying the starting gate, its manufacturer, or containing operating instructions, may be posted or otherwise provided.

Finally, FIG. 2 illustrates that the housing parts 3*a* and 3*b* can be connected to one another by screws 49 which are threaded into respective holes 50. Thus, the housing 3, together with the components contained therein, constitutes an integral unit which is received in the channel 22 of the base 2 which is bounded by the ridge 21 of the base 2. Thus, the housing member 3 can be easily disassembled from the base by withdrawing it from the channel 22, for storage or transportation purposes.

The operation and function of the above-discussed starting gate has already been discussed to some extent while the structure of the starting gate 1 was explained. Nevertheless, to present a complete picture, the operation of the starting gate 1 will now be briefly recapitulated.

When it is desired to engage in a toy vehicle race, the base 2 is placed on a level surface, and the tracks 5*a* and 5*b*, as well as the housing member 3, are assembled therewith. The non-illustrated charged toy vehicles are placed into the respective bays 6*a* and 6*b* and are retained therein by the retaining portions 7*a* and 7*b* of the starting elements 11*a* and 11*b*. The indicating member 25 is displaced into its first or uppermost position by gripping the gripping portion 29 and displacing the same outwardly, while the cam follower 32 conducts a similar motion in the passage 31 of the can. track 30, until the cam follower 32 is received and supported in the enlarged portion 33 of the passage 31. It will be appreciated that the pin 32 will rest on the lower horizontal surface bounding the enlarged portion 33, so that it will not have any tendency to spontaneously enter the main portion of the passage 31. In this position of the indicating member 25, the portion 36 thereof extends through the opening 37 to the exterior of the housing 3. If need be, the cylindrical portions 46*a* and 46*b* of the indicating members 23*a* and 23*b* are rotated to bring the indicating element 23*a* and 23*b* into their concealed positions. At this time, everything is ready for the commencement of the race, particularly of the countdown sequence.

Now, the portion 36 of the indicating member 25 is displaced laterally in the opening 37, until the cam follower 32 enters the zig-zagging main portion of the passage 31 bounded by the cam track 30. From now on, gravitational forces will displace the indicating member 25 downwardly, but the motion of the indicating member 25 will be controlled and retarded by the cooperation and contact of the cam follower 32 with the sections 34 of the cam track 30. As the indicating member 25 gradually descends, the yellow area of the front face of the indicating member 25 will become successively visible in the openings 41*a* and 41*b*, until the indicating member 25 reaches its lowermost position, where the green areas provided on the projections 38*a* and 38*b* of the indicating member 25 become visible in the openings 43*a* and 43*b*.

Downward depression of the respective actuating portion 9*a* or 9*b* of the respective starting element 11*a* or 11*b* causes the respective retaining portion 7*a* or 7*b* to be withdrawn into its respective opening 8*a* or 8*b*, whereupon the charged toy vehicle accommodated in the respective bay 6*a* or 6*b* is released for travel onto and on the respective track 5*a* or 5*b*. As explained above, the respective control portion 19*a* or 19*b* is withdrawn simultaneously with the retraction of the respective retaining portion 7*a* or 7*b*. Thus, should the actuating portion 9*a* or 9*b* be depressed during the countdown sequence, the support provided for the respective indicating element 23*a* or 23*b* by the control portion 19*a* or 19*b* is withdrawn and the indicating member 23*a* or 23*b* will pivot into its equilibrium or revealed position in which it can be observed through the opening 45*a* or 45*b*. This provides an indication of the premature depression of the respective actuating portion 9*a* or 9*b* during the countdown sequence, that is, before the indicating member 25 has reached its lowermost position illustrated in FIGS. 4 and 5.

On the other hand, when the respective actuating portion 9*a* or 9*b* is depressed only after the indicating member 25 has reached its lowermost position, the protrusion 26*a* or 26*b* of the indicating member 25 will prevent the respective indicating member 23*a* or 23*b* from pivoting into its equilibrium position upon withdrawal of the control portion 19*a* or 19*b*, by extending into the path of the pivoting movement of the respective pin 27*a* or 27*b* and providing an abutment for the same. Consequently, if the respective actuating portion 9*a* or 9*b* is depressed only upon the termination of the countdown sequence, the respective indicating element 23*a* or 23*b* will be retained in its concealed position and will not appear in the respective opening 45*a* or 45*b*. Of course, the absence of the indicating element 23*a* or 23*b* from the opening 45*a* or 45*b* is an indication of the depression of the actuating portion 9*a* or 9*b* at the proper time, that is, after the termination of the countdown sequence. Consequently, an inadvertent or intentional premature release of the respective charged toy vehicle onto the respective track 5*a* or 5*b* can be detected or determined, and that particular vehicle can be disqualified, or the race can be repeated under the proper conditions.

It is advantageous when the width of the passage 31 is greater than the diameter of the cam follower 32, inasmuch as the cam follower 32 will drop a small distance when it leaves the trailing end portion of one section 34 and before it reaches the leading end portion of the next successive section 34. In this manner, noise will be generated as the cam follower 32 first contacts the respective section 34 of the cam track 30, so that an additional audible indication of the progress of the starting member 25 towards its lowermost position is provided, supplementing a visual indication provided by viewing the starting member 25 through the openings 41*a* and 41*b*.

It will be seen that there is provided a starting gate for use in a multiple track toy vehicle racing arrangement which achieves the various objects of the invention and which is well adapted to meet the conditions of practical use.

Inasmuch as various possible embodiments might be made of the above invention, and since various changes might be made in their embodiment set forth above, it is to be understood that all matter herein described or shown in the accompanying drawings is to be interpreted as illustrative only and not in a limiting sense. The scope of protection which is being sought will appear exclusively from the accompanying claims.

We claim:

1. A starting gate for use in connection with a multiple track toy vehicle racing arrangement for releasing self-propelled toy vehicles onto the tracks, comprising a base bounding a cavity and and having plurality of bays each for one of the vehicles and each aligned with one of the tracks; a plurality of starting elements each mounted in said cavity for independent displacement between an extended and a retracted position and each having a blocking portion retaining the respective vehicle in the respective bay in said extended position and releasing said respective vehicle for travel from said respective bay onto the respective track in said retracted position of said starting element, and an actuating portion displacing said starting element at least into said retracted position upon actuation; means for biasing said starting elements toward said extended position including a leaf spring mounted on said base within said cavity and acting on the respective starting element, first indicating means for indicating a countdown sequence preceeding the start; and second indicating means for indicating a premature displacement of a respective starting element into said retracted position prior to the termination of said countdown sequence.

2. A starting gate as defined in claim 1; further comprising a hollow housing member supporting said first and second indicating means, said housing member and base having aligned apertures communicating said cavity with the interior of said housing member; and wherein each of said starting elements further has its respective control portion extending through said apertures and controlling the operation of at least said second indicating means.

3. A starting gate as defined in claim 2, wherein said second indicating means includes an indicating element for each of said starting elements, mounted in said housing member for movement between a concealed and a revealed position in which said indicating element is respectively invisible and visible externally of said housing member, and urged toward said revealed position, and means for resetting said indicating elements into said concealed positions thereof; and wherein said control portion of the respective starting element so engages said indicating element as to maintain the same in said concealed position as long as said respective starting element assumes said extended position thereof, while releasing the same for movement toward said revealed position upon displacement of said respective starting element toward said retracted position thereof.

4. A starting gate as defined in claim 3, wherein each said indicating element is mounted in said housing member for pivoting about an axis and has a center of gravity sufficiently offset from said axis for gravitational forces to pivot said indicating element toward said revealed position upon release by said control portion.

5. A starting gate as defined in claim 3, wherein said housing member has at least one zone through which light can pass into and out of the interior of said housing member; and wherein said indicating element is respectively in and out of registry with said zone in said revealed and concealed position thereof.

6. A starting gate as defined in claim 3, wherein said first indicating means includes an indicating member supported by said housing member for displacement during said countdown sequence from a first to a second position and having engaging portions each of which so engages one of said indicating elements at least when the latter is in said concealed position and only while said starting member is at said second position as to keep said one indicating element in said concealed position even upon release thereof by the respective control portion of the respective starting element.

7. A starting gate as defined in claim 6, wherein said indicating member is at least partially accommodated in said housing member; and wherein said housing member has at least one light-permeable portion through which the progress of said indicating member from said first to said second position during said countdown sequence can be observed.

8. A starting gate as defined in claim 7, wherein said starting member is subjected to forces of such magnitude during said countdown sequence as to tend to proceed toward said second position at an undesirably high speed; and further comprising means for retarding the progress of said indicating member at least toward said second position thereof.

9. A starting gate as defined in claim 8, wherein said retarding means includes a cam track on one of said members, and a cam follower on the other member and contacting said cam track of said one member.

10. A starting gate as defined in claim 9, wherein said cam track includes at least one cam track surface contacted by said cam follower and sloping downwardly over its entire course.

11. A starting gate as defined in claim 10, wherein said cam surface includes a plurality of separate first sections sloping in one direction; and wherein said cam track further includes an additional cam surface including a plurality of separate second sections situated in alternating succession with said first sections and sloping in the opposite direction so that said first and second sections cause said cam follower to travel in a zig-zagging path during said countdown sequence.

12. A starting gate as defined in claim 11, wherein said cam track further includes first and second connecting zones respectively interconnecting said first and second sections, and preventing said cam follower from leaving said cam track therebetween.

13. A starting gate for use in connection with a multiple track toy vehicle racing arrangement for releasing self-propelled toy vehicles onto the tracks, comprising a base having a plurality of bays each for one of the vehicles and each aligned with one of the tracks; a plurality of starting elements each mounted on said base for independent displacement between an extended and a retracted position and each having a blocking portion retaining the respective vehicle in the respective bay in said extended position and releasing said respective vehicle for travel from said respective bay onto the respective track in said retracted position of said starting element at least into said retracted position upon actuation; a first indicating means moveable with respect to said base and providing visual indication of a countdown sequence preceding the start of a race, a second indicating means responsive to control portions of said starting elements and disposed between said first indicating means and each of said starting elements and moveable to visually indicate occurrence of premature activation of the associated starting element, and cooperating means on said first and second indicating means engageable upon completion of said countdown sequence to prevent movement of the second indicating means when the associated starter element is thereafter activated.

14. A starting gate as defined in claim 13, wherein a projecting control portion, carried by and movable with each starting element engages the associated second indicating means to prevent movement thereof when the starting element is in said extended position.

15. A starting gate as defined in claim 13, wherein a projecting control portion, carried by and movable with each starting element engages the associated second indicating means to prevent movement thereof when the starting element is in said extended position, and a manually engagable control on each of said second indicating means facilitating movement thereof to re-establish engagement with said projecting control portion, and thereby reset said second indicating means, after a premature activation of the associated starting element.

* * * * *